United States Patent [19]

Seidler

[11] 3,987,264

[45] Oct. 19, 1976

[54] METHOD, APPARATUS AND PRODUCT RELATING TO ELECTRICAL CONTACT

[75] Inventor: Jack Seidler, College Point, N.Y.

[73] Assignee: North American Specialties Corporation, Flushing, N.Y.

[22] Filed: Dec. 9, 1974

[21] Appl. No.: 530,518

Related U.S. Application Data

[63] Continuation-in-part of Ser. No. 363,947, May 25, 1973, abandoned.

[52] U.S. Cl. ..... 200/267

[51] Int. Cl.[2] ..... H01H 1/02

[58] Field of Search ..... 200/267, 246, 268, 262, 200/263, 238

[56] References Cited

UNITED STATES PATENTS 3,268,701 8/1966 La Plante et al. ..... 200/267

*Primary Examiner*—Herman Hohauser

*Attorney, Agent, or Firm*—Stanley J. Yavner

[57] ABSTRACT

A method and apparatus is provided to produce a gold, inlaid contact surface for an electrical contact device by welding gold ribbon segments to the contact device wire base prior to the coining, trimming, slotting and various other forming operations which transform the wire base into a finished contact device. The apparatus features a sequential arrangement of gripping devices which manipulate the gold ribbon for processing as stated above, a welding apparatus for combining the gold ribbon segment with the contact wire base, a cutting device for cutting the gold ribbon and apparatus for forming the finished electrical contact device. The product features a formed contact device including a wire support member and a contact material simultaneously formed and flattened, to provide a minimum amount of inlaid or coined gold for effecting desirable contact characteristics. The grain of the contact material is transversely oriented to the grain of the wire support member for improved flexure performance of the product and the contact material is substantially planar with the wire support to avoid chipping.

2 Claims, 13 Drawing Figures

METHOD, APPARATUS AND PRODUCT RELATING TO ELECTRICAL CONTACT

This application is a continuation in part of copending U.S. Pat. application Ser. No. 363,947, filed May 25, 1973 now abandoned, inventor Jack Seidler, assigned to North American Specialties Corp. and relates primarily to electrical contact devices and more particularly to an apparatus and method for forming such a device with simultaneously coined gold contact points.

With the advent of sophisticated electrical and electronic equipment during the past twenty years, a great deal of attention has been denoted by designers and systems personnel to the electrical contact devices useful with such equipment. Particularly, printed circuit cards have caused a reshaping of the designers' thinking with respect to contact devices useful therewith. Of necessity, such contact devices must increase their sophistication to cope with the circuit changes which have occurred because of miniaturization and increased power capability. A positive, reliable, longlife contact device is necessary to perform the desired functions. Thus, designers have turned to small, yet strong contact devices that are light in weight and which use precious or other metal contact materials. Such contact devices are presently manufactured by first forming the complete contact and then applying the various inlaying and braising methods to bond the contact material. A product is produced which, of necessity, even after coining, includes a protruding contact area of the precious metal contact material. Furthermore, because of the nature of the product and method, a great amount of the processed material must be used to provide the desired function. The excess contact material and the protruding nature of the finished product at the point of contact leads to inevitable difficulties. For instance, upon contact with the printed circuit card, it is not unusual for the precious contact material to chip off and defeat the intended functioning of the contact device.

Also, manufacturers do not arrange grain orientation for the contact material and base material to enable improved flexure characteristics and sheet stock, rather than wire base materials, is commonly used.

Accordingly, a primary object of the present invention is to provide a method and apparatus for producing contact devices which are reliably and suitably designed for an extended life period.

A further object is to provide a contact device product which is devoid of unnecessary contact protrusions which might chip off during use.

A still further object is to provide a method for producing a contact device with a gold contact area which is coined along with the contact device itself and which is applied prior to the various forming steps traditionally used for such contact devices.

Another object is to provide a contact device having grain orientation arranged by use of wire base material stock to enable improved flexure characteristics.

These and other objects are accomplished in one preferred, but nonetheless illustrative embodiment of the present invention which features an electrical contact device including a contact area of precious metal. The contact area is coined simultaneously with the main wire base body of the contact device and protrudes only by a minimum amount from that main body. A contact as above described is produced by means of apparatus including primary and secondary gripping devices arranged sequentially along a first path along with precious metal contact material flows. Generally perpendicular to the first path is a second path along which wire material for the main body of the contact device is fed. Substantially at the point of intersection of the two paths, a cutting device and a welding apparatus are arranged to function as will be immediately described. For instance, gold ribbon is fed along the first path and upon its leading edge reaching the aforementioned intersection point, the welding apparatus bonds it to the upper face of the squarely or rectangularly sectioned contact device wire base material. A cutter then severs the welded gold material from the balance of the gold ribbon. Flow of the gold ribbon to the intersection point is facilitated by gripping of the ribbon by the primary gripping device, motion towards the intersection point of the primary gripping device, clamping by the secondary gripping device at the instant when the ribbon's leading edge reaches the intersection point, release by the primary gripping device which then moves back to its original position to grip a new length of gold ribbon and the process is then repeated continuously. After welding and cutting as previously described while the secondary gripping device engages the gold ribbon, the forming operations take place for the combined precious metal contact area and the wire base of the electrical contact device. The various gripping devices, cutting device and welding apparatus are operated primarily by pneumatic means from a central cam control, but, of course, various other motive arrangements are contemplated and may be used within the scope of the present invention.

The above brief description, as well as further objects, features and advantages of the present invention will be more fully appreciated by reference to the following detailed description of the preferred, but nonetheless illustrative, embodiment when taken in conjunction with the accompanying drawings wherein.

Figure 1:
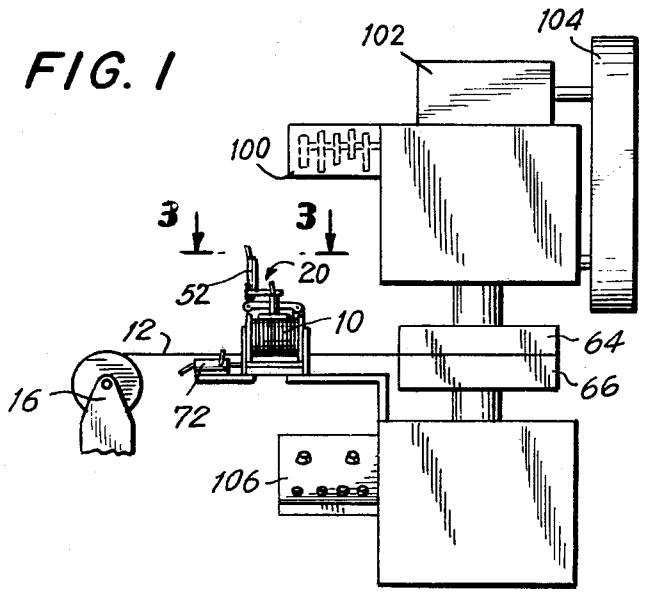
FIG. 1 is a schematic representation of an apparatus useful in performing the method and producing a product according to the present invention.
Figure 2:
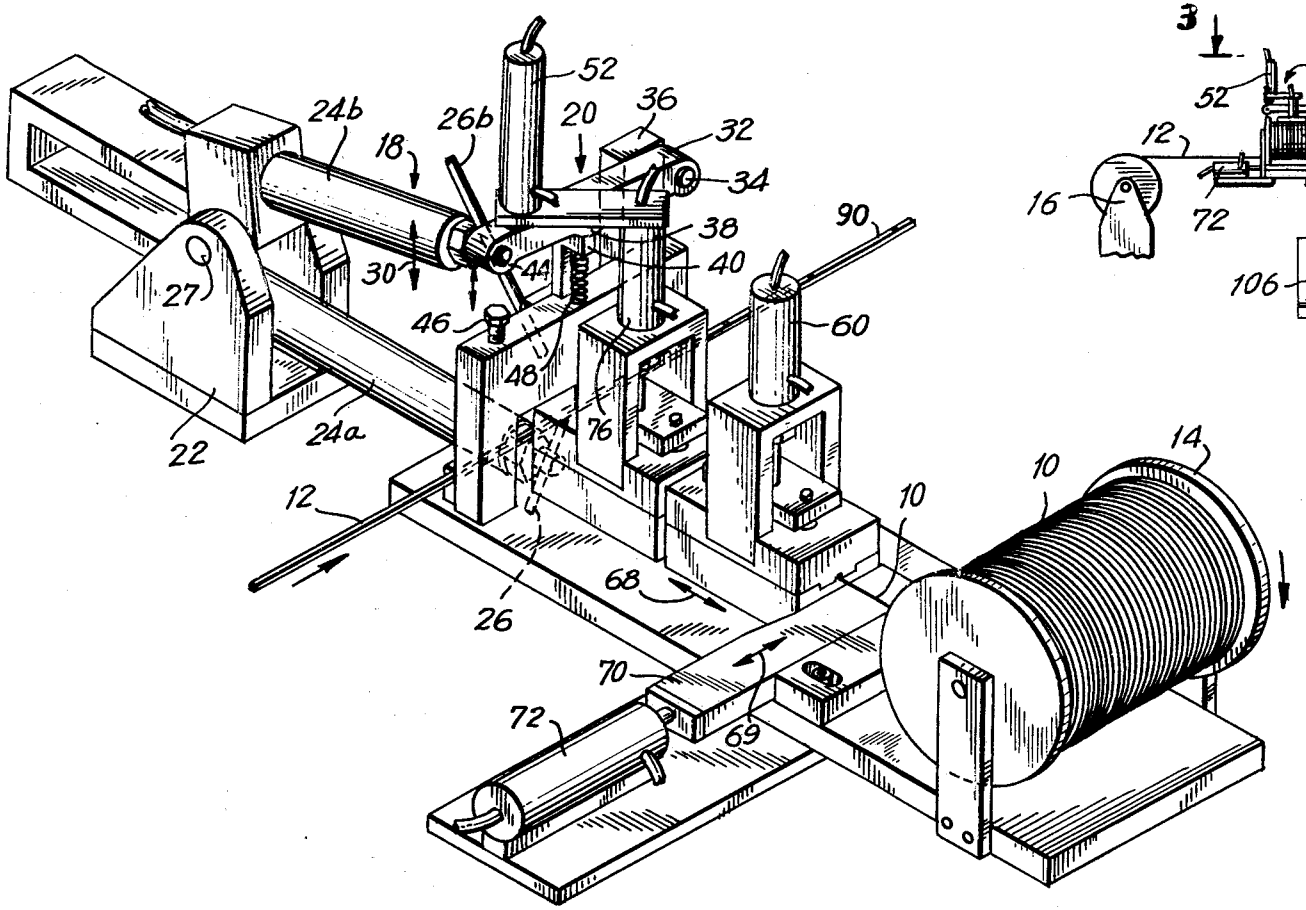
FIG. 2 is an isometric view of such apparatus.

Referring to the drawings, and in particular to FIGS. 1 and 2 thereof, an apparatus is shown in both top schematic and isometric view as being designed with reference to first and second paths defined by a ribbon 10 of gold contact material and contact support member 12, respectively. The gold ribbon contact material is fed from a spool 14 and the supply of contact support member 12 (hereinafter referred to in some cases as wire) is a spool or drum or any other convenient housing 16. The two paths are arranged in a generally perpendicular orientation and located proximate to their intersection point is a welding apparatus generally designated 18 and a cutting device generally designated 20.

The gold ribbon 10, by the nature of its forming process, is characterized by grain orientation longitudinally of the ribbon. Likewise, the wire support member 12 has grain orientation longitudinally of itself and longitudinally therefore of the final product.

The welding apparatus comprises a frame 22, insulators 24*a*, 24*b* and electrodes 26*a*, 26*b*. Of course, the welding apparatus 18 is powered by a convenient source of power (not shown) which feeds the welding apparatus 18. The upper electrode 26*b* of welding apparatus 18 is movable in directions 30 and is controlled by means of pivot 27 and an appropriate pneumatic system for rocking the upper electrode 26*b* in the directions indicated. Motions of electrode 26*b* in directions 30 serve to bring the electrodes 26*a*, 26*b* into operative proximity as shown particularly in FIG. 6 and to retract electrode 26*b*.

Figure 7:
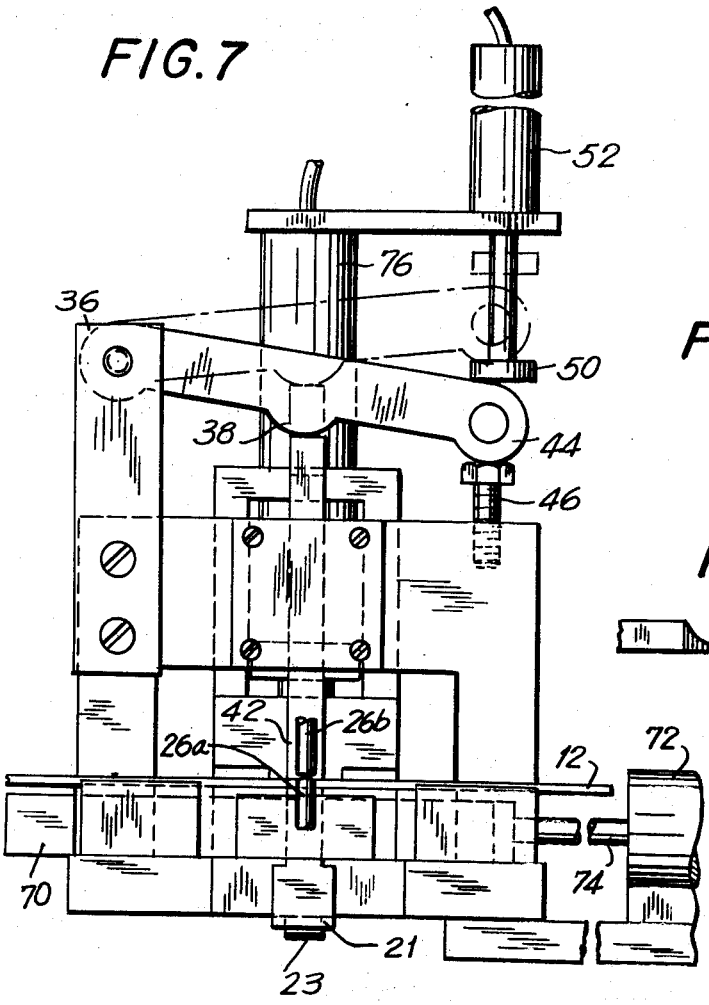
FIG. 7 is a front sectional view, taken along the line 7—7 of FIG. 5, and showing particularly the various rocker arm positions for actuating the cutting device.

The cutting device 20 is basically controlled by rocker arm 32 which is pivoted at point 34 with reference to frame segment 36. Rocker arm 32 defines a downwardly eccentric midpoint 38 which bears down upon slidable arm 40 to cause a downward motion of cutting tool 42 (FIG. 7). The motion of rocker arm 32 downwardly is limited by the interaction of its end eccentric 44 and stop bolt 46. Stop bolt 46 is threaded to allow for adjustment of the extent of motion of rocker arm 32. Upward motion of cutting tool 42 is enabled by spring 48 and the entire rocker arm downward motion is provided by plunger 50 (FIG. 7) as controlled by pneumatic air cylinder 52 and associated apparatus. It is to be understood throughout this specification that the pneumatic motion systems can be replaced by any convenient motive arrangement suitable for the functions described.

The cutting device 20 further includes floating platform 21 whose floating action in an upward and downward direction is enabled by spring 232. Floating platform 21 performs the function of cushioning the downward motion of cutting tool 42 (FIG. 6) which must have enough room to shear gold ribbon 10 and yet, when cutting tool 42 lifts, the gold ribbon 10 must be in a position just above the plane of wire 12. Spring 23 and the upward end 21a of floating platform 21 provide the function of first enabling a limited downward motion and then lifting gold ribbon 10 to a plane just above the plane of wire 12. Otherwise, gold ribbon 10 would butt the wire 12 when the gold ribbon is moved towards the intersection point.

Referring to the other drawings as well, the first path defined by gold ribbon 10 features a sequential arrangement of a primary gripper generally designated 56 and a secondary gripper generally designateed 58. Generally, the primary and secondary grippers perform the function of bringing the gold ribbon to the aforementioned point of intersection, holding the ribbon in place during the welding and cutting operations and then bringing another length of gold ribbon through the same process. Basically, these functions are performed by a sequence and apparatus depicted in FIGS. 3 through 6 wherein the primary gripper 56 is shown to include an appropriate pneumatic air cylinder 60 or other applicable motion apparatus, a piston 62 controlled by cylinder 60, a plunger frame generally designated 64, a base 66 and a track arrangement whereby primary gripping device 56 may be moved in directions 68 (FIG. 6) by an amount equal to the amount of gold ribbon to be deposited and welded on each section of wire 12. Motion of primary gripping device 56 in directions 68 is provided by a pneumatically operated platform cam 70 moving in directions 69 under the influence of air cylinder 72 and piston 74.

The reverse direction motion is provided by rearwardly facing and extending spring bumpers 81 on base 82 of the secondary gripping device 58. Secondary gripping device 58 also includes substantially the same structure with air cylinder 76. piston 78, a plunger generally designated 80 and a base 82.

Figure 8:
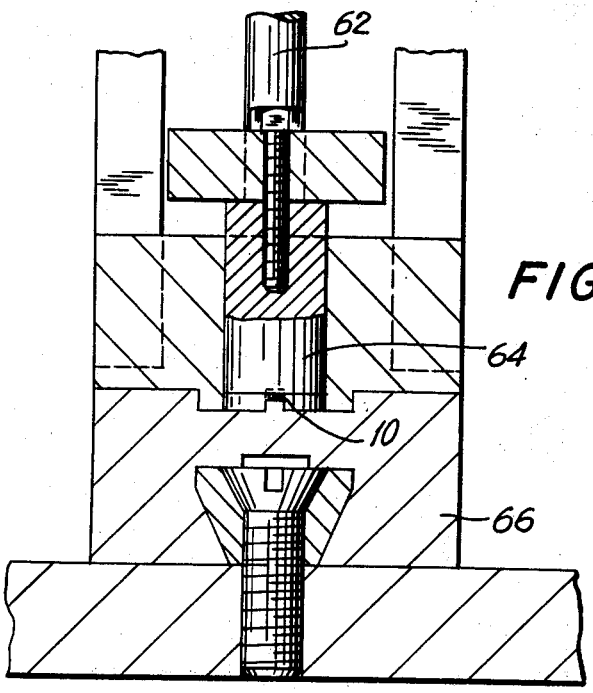
FIG. 8 is a front sectional view taken along the line 8—8 of FIG. 4 and showing particularly the gripping of the gold ribbon by the primary gripping device.

With both gripping devices, plunger 64 (or 80) clamps down on gold ribbon 10 to force it against base 66 (or 82) as shown in FIG. 8 representing the primary gripping device only.

Figure 3:
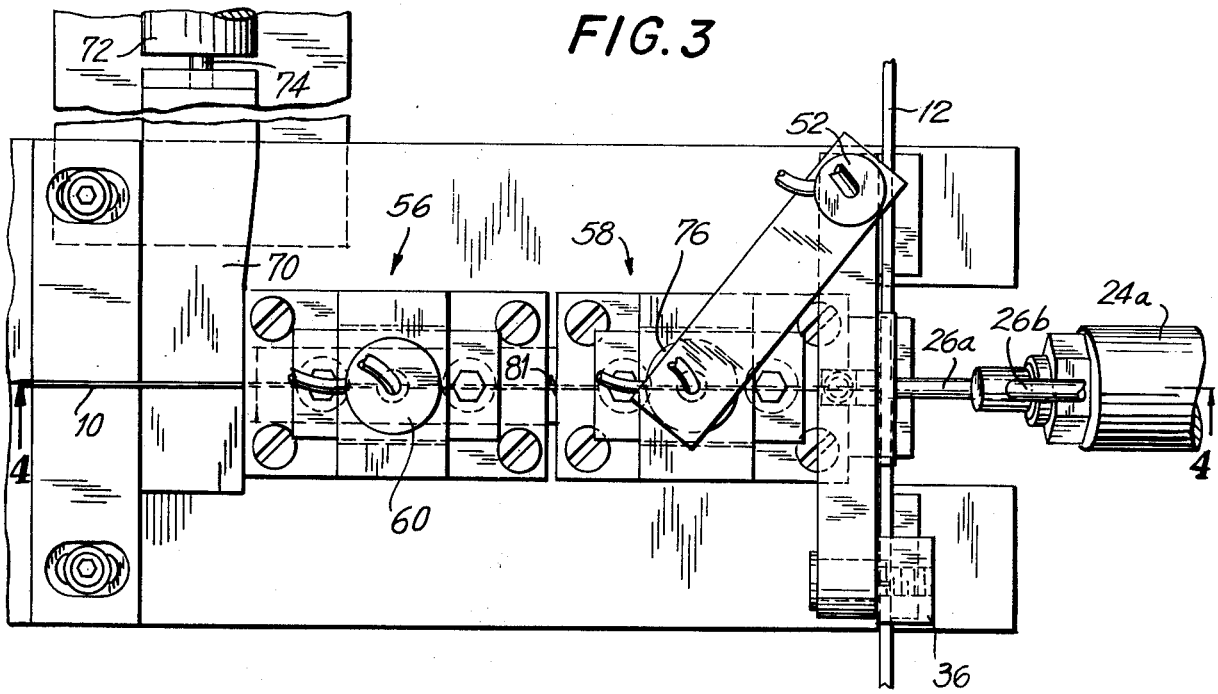
FIG. 3 is a top plan view, enlarged, of the primary and secondary gripping devices and associated apparatus taken along the line 3—3 of FIG. 1, and showing a cam platform in retracted position at the time the primary gripping device first grips the gold ribbon moved thereby.
Figure 4:
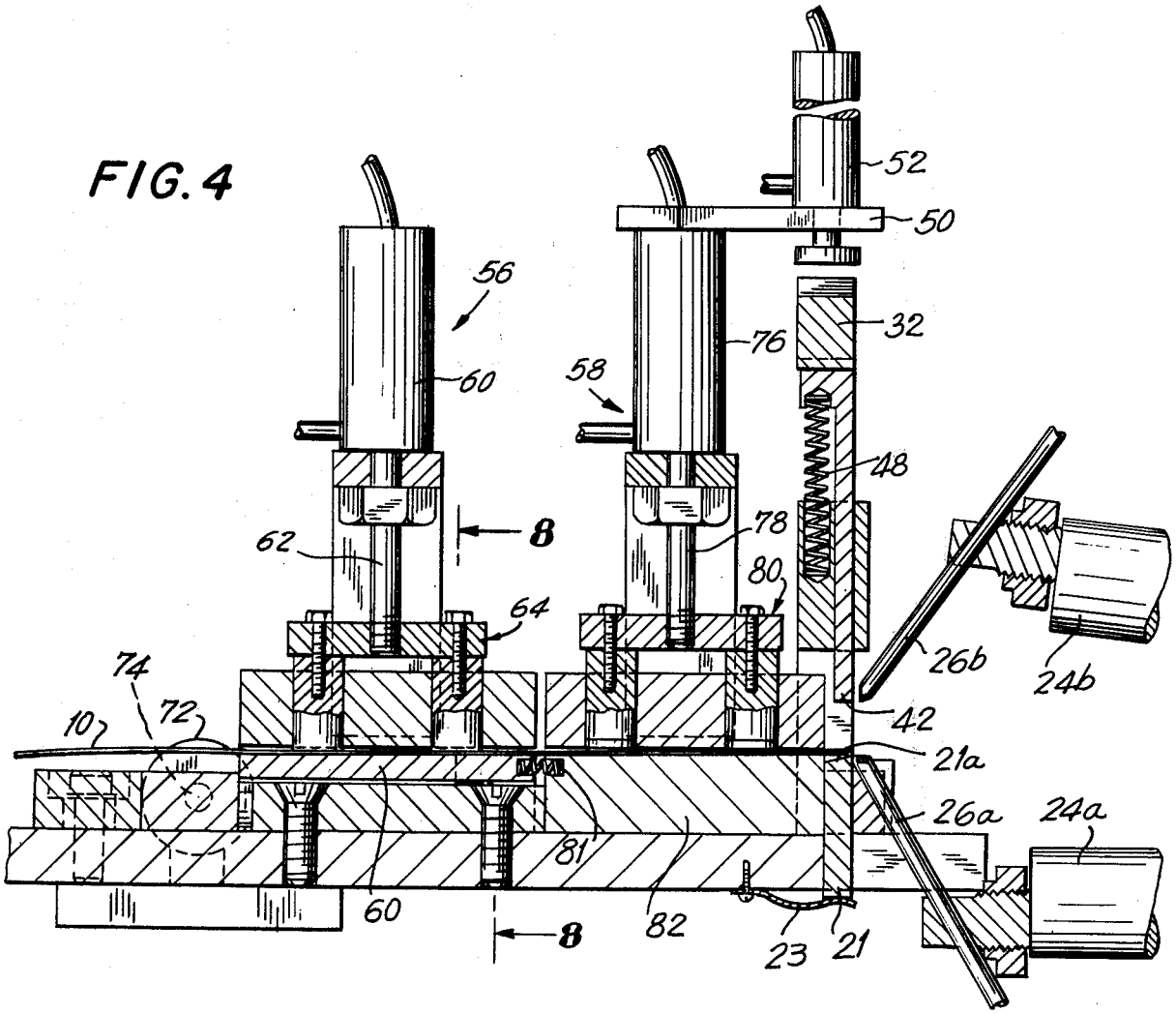
FIG. 4 is a front sectional view taken along the line 4—4 of FIG. 3 and showing particularly the gripping devices, the welding apparatus and the cutting device of the apparatus of the present invention, and also depicting pneumatic operating devices associated therewith.
Figure 5:
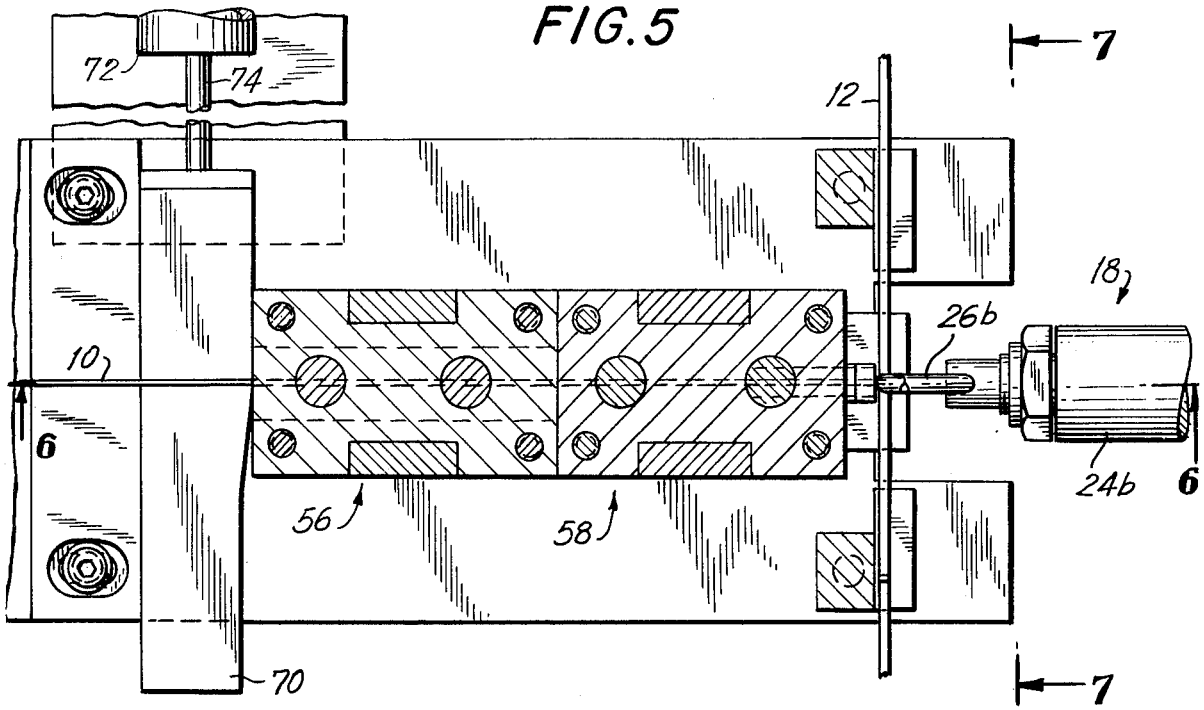
FIG. 5 is a view similar to that shown in FIG. 3, but with the cam platform in extended position forcing the primary gripping device towards the leading edge of the gold ribbon moved thereby.
Figure 6:
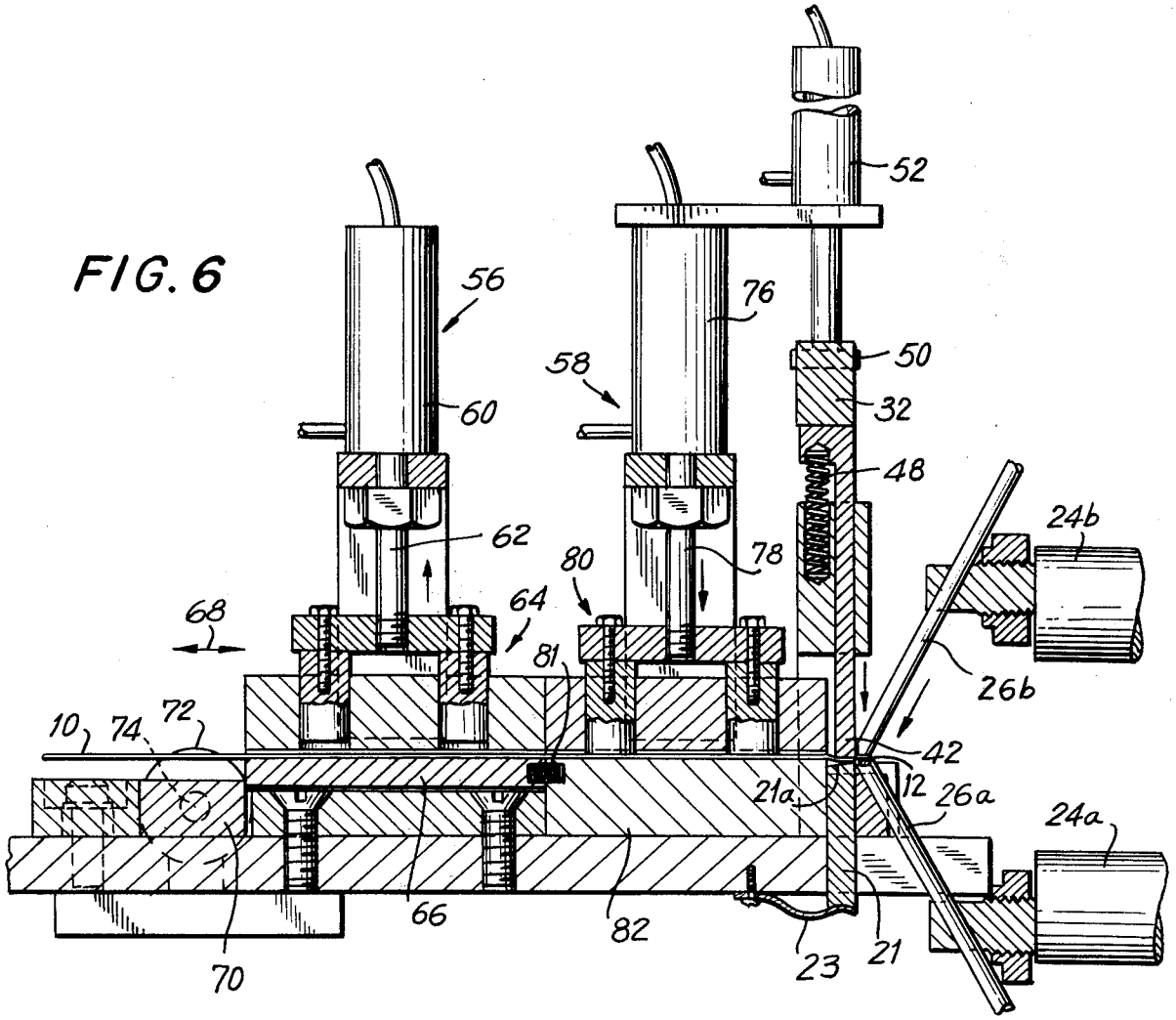
FIG. 6 is a side sectional view of the apparatus of FIG. 5, taken along the line 6—6 thereof, showing the position of gripping devices at the time of welding and just as the cutting device is operating.

Thus, FIGS. 3 and 4 represent the initial position of both gripping devices with cam platform 70 in retracted position. At this point, the primary gripper device 56 is activated to engage gold ribbon 10. It should also be noticed that electode 26*b* of welding apparatus and cutting tool 42 are both in non-operative position. FIGS. 5 and 6 show the first path apparatus with the primary gripper moved by means of cam platform 70 towards the intersection point. At this point in time, electrode 26*b* of the welding apparatus is lowered and operated and the cutting tool is performing its function, both happening while the secondary gripping device 58 engages gold ribbon 10. Also at this point in time, the primary gripping device 56 releases and will be moved back to its original position (FIGS. 3 and 4) to engage another length of gold ribbon 10.

Figure 9:
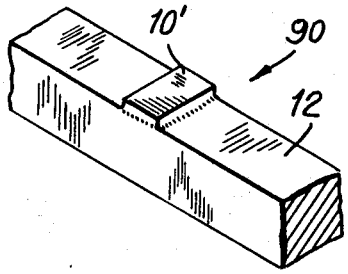
FIG. 9 is an exaggerated pictorial representation of a section of contact material wire blank with a segment of gold ribbon transversely welded thereon at the time just after such welding.

The overall function of the apparatus to perform as just described for the individual operations stations has as its goal to produce a contact wire coated with gold 10' as shown at 90 in FIGS. 2 and 9, so that the wire can be further processed as will be described with reference to FIGS. 10, 10A, 10B and 11.

The method includes the following steps: arranging a first path defined by gold ribbon 10 and a second path defined by contact wire 12 so that the two paths (and the respective grain orientations) are approximately perpendicular to each other, gripping gold ribbon 10 with a primary gripping device 56, moving gold ribbon 10 towards the intersection point, gripping the gold ribbon with secondary gripping device 58 and simultaneously releasing the primary gripping device 56 so that the primary gripping device can retract to engage a new length of gold ribbon 10, welding the gold ribbon which overlays the contact wire proximate the point of intersection so that the gold ribbon is bonded to contact support wire 12, cutting the gold ribbon so that only the section thereof which is welded to contact wire 12 remains with little or no overlay and moving contact wire 12 for further forming processing.

The schematically presented apparatus of FIG. 1 enables functioning of the apparatus as above described by use of a cam 100, which operates the pneumatic air cylinders connected to the various stations of the apparatus, and which cams are in turn operated by use of the motor 102 and fly wheel 104. A control panel 106 is likewise used to program the apparatus. The programming and operation is such that cylinder 60 connected with the station including primary gripping device 58 is operated first in order to grip gold ribbon 10, air cylinder 72 is then operated to move cam platform 70 in order to carry gold ribbon 10 towards the intersection point, air cylinder 76 is then operated approximately simultaneously with the pneumatic system for lowering electrode **26*b* of the welding apparatus so that the secondary gripping device engages gold ribbon 10 during welding, and also approximately simultaneously the air cylinder 50 is again operated to release the engagement of primary gripping device 56 which is allowed to move back to pick up a new length of gold ribbon by the return action of cam platform 70, and then cylinder 52 is operated to lower the cutting tool for severing the gold ribbon at the side edge of contact wire 12.**

Figure 10:
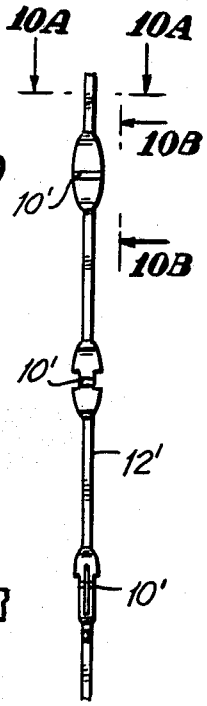
FIGS. 10, 10A and 10B are representations of the electrical contact device at various stages of forming while the gold ribbon segment is welded thereto.
Figure 10A:
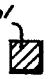
Figure 10B:
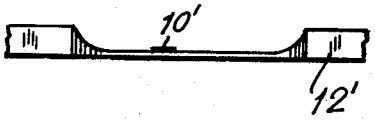
Figure 11:
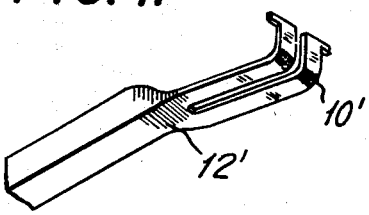
FIG. 11 is an isometric representation of a finished electrical contact device, with grain orientation longitudinally of the device for the base material and transversely thereof for the contact material.

FIGS. 10 and 11 illustrate the further forming of contact wire 12 (hereinafter 12') after the above method has been accomplished. FIGS. 10, 10A, 10B and 11 illustrate such further processing which may be accomplished by available apparatus and methods. As shown in the drawings, the gold ribbon 10' is formed and flattened simutaneously with contact wire 12' so that only a minimum amount of gold need be used and yet it is sufficiently spread during the further processing to provide ample contact capability and strength. The final product is unlike the exaggerated protrusion of gold shown in FIG. 10B, the gold extension from contact wire 12' being minimum enough to avoid the drawbacks suffered by gold coated devices presently available on the market.

FIG. 11 shows substantially the finished product with gold 10' inlaid and coined and therefore formed and flattened with contact wire 12' in a structure useful with various types of electrical and electronic equipment.

What is claimed is:

1. An electrical contact device for operation by electric contact with a mating component comprising a combined and simultaneously formed and flattened wire support member and contact material, which contact material is transversely oriented to said wire support member for providing improved flexure characteristics and presents a substantially planar contact face having sufficiently spread contact material exposed to provide contact capability with said mating component and strength without waste of said contact material, said substantially planar contact face avoiding chipping of said contact material during use.

2. The invention according to claim 1 wherein said contact material is gold.

* * * * *